US008919394B1

(12) United States Patent
Marefat

(10) Patent No.: US 8,919,394 B1
(45) Date of Patent: Dec. 30, 2014

(54) SANITARY GUARD FOR ORAL CARE COMPOSITION DISPENSER

(76) Inventor: Mary Marefat, Needham, MA (US)

( * ) Notice: Subject to any disclaimer, the term of this patent is extended or adjusted under 35 U.S.C. 154(b) by 38 days.

(21) Appl. No.: 13/566,430

(22) Filed: Aug. 3, 2012

(51) Int. Cl.
*B65B 1/04* (2006.01)

(52) U.S. Cl.
USPC ..... 141/346; 222/95; 222/105; 222/214

(58) Field of Classification Search
USPC ..... 141/346, 351–354, 360–362; 222/93, 222/95, 101, 105, 214
See application file for complete search history.

(56) References Cited

U.S. PATENT DOCUMENTS

| | | | | | |
|---|---|---|---|---|---|
| 2,096,259 | A * | 10/1937 | Orihel | ..... | 222/181.2 |
| 2,389,683 | A * | 11/1945 | Page | ..... | 141/320 |
| 2002/0036028 | A1 * | 3/2002 | Goldman | ..... | 141/373 |
| 2007/0259307 | A1 * | 11/2007 | Quan et al. | ..... | 433/25 |

* cited by examiner

*Primary Examiner* — Jason K Niesz
(74) *Attorney, Agent, or Firm* — Joseph E. Funk

(57) ABSTRACT

A sanitary guard is disclosed which is attached to the dispensing spout of an automatic toothpaste dispenser with an interference fit. Toothpaste is dispensed through the sanitary guard onto a toothbrush positioned in a slot below the guard to assure the toothpaste will be on the toothbrush bristles. The sanitary guard helps prevent the toothbrush from touching the dispensing spout for sanitary protection. In addition, the sanitary guard is made from a plastic having nanosilver compounds therein that give it germicidal properties for sanitary protection.

8 Claims, 3 Drawing Sheets

SANITARY GUARD FOR ORAL CARE COMPOSITION DISPENSER

FIELD OF THE INVENTION

The present invention relates generally to dispensers for oral care compositions suitable for cleaning the oral cavity.

BACKGROUND OF THE INVENTION

Toothpaste dispensers are well known in the art. Most existing toothpaste dispensers are in the form of simple tubes that dispense toothpaste when users manually squeeze the tubes. Some of these tubes are formed of flexible plastic, and older ones of these tubes were formed of a soft, malleable metal. Alternatively, some toothpaste dispensers exist in a pump form. Simpler versions of these pump dispensers are manual and a user operates them by depressing the top of the dispenser, and other variants utilize a pump lever on the dispenser. Such toothpaste dispensers are not user-friendly for people who have arthritis in their hands or have other physical limitations such as Parkinson's disease.

In addition, such traditional tube and pump toothpaste dispensers are messy. It is easy to squeeze a tube of toothpaste or to press a manual pump type toothpaste dispenser with an incorrect amount of pressure and eject too much toothpaste that falls on a counter or, worse, on the floor. Further, the caps of tube type toothpaste dispensers often become messy and covered with toothpaste that dries out and thereby makes a worse mess.

In view of the shortcomings described above automatic toothpaste dispenser that can dispense toothpaste without manual operation have come into vogue. They are easier to use, thereby making it easier for young and old to brush their teeth. They are then subtly encouraged to brush their teeth more often. As a result automatic toothpaste dispensers promote oral hygiene.

While automatic toothpaste dispensers have made it easier to dispense toothpaste onto a brush they are still not user-friendly for people who have arthritis in their hands or who have other physical limitations such as Parkinson's disease. These people have difficulty in holding the bristle end of a toothbrush under the dispensing spout of the automatic toothpaste dispensers and the toothpaste too often does not go onto the bristles but, rather, onto the counter or floor.

Whether toothpaste tubes, manually operated toothpaste dispensers or automatic toothpaste dispenser, they all have a common problem. A person using them often touches the opening where the tooth is dispensed from such devices with the bristles of their toothbrush. This creates a hygienic problem because the bristles and handles of virtually all toothbrushes have germs, bacteria and sometimes viruses thereon. A fast rinse of a toothbrush under a running faucet after brushing does not properly clean a toothbrush. They still have germs, bacteria and viruses thereon. Very few families will have a separate toothpaste dispensers for each person in a family and germs, bacteria and viruses are thereby easily spread between members of a family or other group who share one of the many types of toothpaste dispensers described above. This problem is exacerbated when people with physical limitations, such as Parkinson's disease, must hold their toothbrush bristles against the opening where the toothpaste is dispensed in order to get the toothpaste on their toothbrush.

Therefore, there is a need for means to dispense toothpaste using a dispenser that is shared by people while minimizing the transfer of germs, bacteria and viruses between the people. In addition, there is a need in the art for means to help a person position their toothbrush to receive toothpaste only onto their toothbrush and thereby minimizing any messes caused during dispensing toothpaste.

SUMMARY OF THE INVENTION

The aforementioned needs in the prior art are satisfied by the present invention. A novel sanitary guard is provided which is easily attached to the dispensing spout of a dispenser of viscous oral care products such as an automatic toothpaste dispenser. The novel sanitary guard helps prevent a person using an automatic toothpaste dispenser with the sanitary guard attached from touching the dispensing spout of the dispenser with the bristles, head or handle of their toothbrush. In addition, the sanitary guard has means to help a person steady their toothbrush and position its bristles under the dispensing spout of the dispenser so that all toothpaste goes onto the bristles. Further, and very important, the sanitary guard is made of an antimicrobial plastic containing nanosilver compounds that kill microbes and microorganisms such as bacteria, germs, viruses and mold that attempt to grow on the surface of the sanitary guard, making its surface germicidal. This helps prevent the spread of such harmful microbes and microorganisms between people using the same toothpaste dispenser equipped with the sanitary guard.

The novel sanitary guard easily mounts to the outer side of a lip of the dispensing spout of an automatic toothpaste dispenser by frictional fit. The guard may easily be removed for cleaning or replacement. The sanitary guard has open sides that visually permit positioning the bristles of a toothbrush under the dispensing spout to receive toothpaste without touching the spout. In addition, the bottom edge of the sanitary guard has a notch in which the handle of the toothbrush is positioned, and the handle is slid along as toothpaste is dispensed onto the toothbrush bristles. This notch keeps the toothbrush bristles far enough away from the dispensing spout so that it ordinarily will not touch the spout. Use of the notch also helps steady a toothbrush to properly receive toothpaste, and this feature is valuable to people who have a physical limitation that hinders them from holding the toothbrush steady without the aid of the notch on the bottom of the sanitary guard.

DESCRIPTION OF THE DRAWINGS

The invention will be better understood on reading the following Detailed Description in conjunction with the drawings in which.

DETAILED DESCRIPTION

Figure 1:
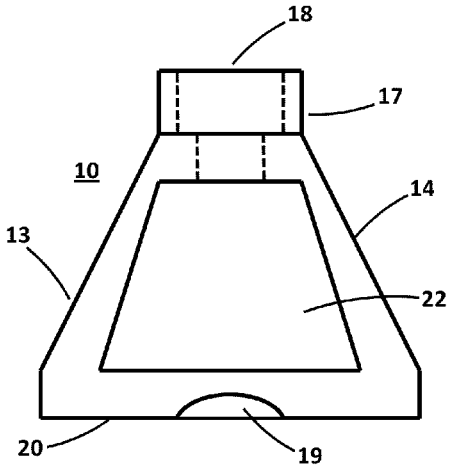
FIG. 1 is a front view of the novel sanitary guard.
Figure 2:
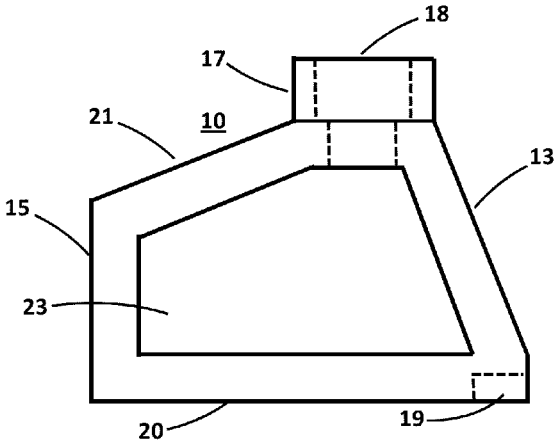
FIG. 2 is a side view of the novel sanitary guard.

FIG. 1 is a front view of the novel sanitary guard 10 in accordance with the teaching of the invention. FIG. 2 is a side view of novel sanitary guard 10. While one shape of the sanitary guard 10 is shown in the drawings the exact shape of sanitary guard 10 is not critical, as long as it contributes to preventing the head and bristles 26 of a toothbrush 24 (FIG. 5) from touching the dispensing spout 11*i* and 11*f* (FIGS. 3, 4, 6, 7) of a dispenser of viscous oral care products which in this Detailed Description is toothpaste dispenser 10 (FIGS. 3, 4, and 6-9).

Figure 3:
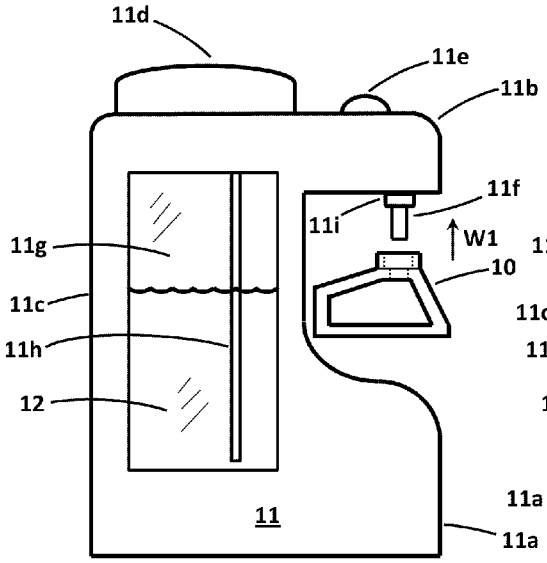
FIG. 3 is a side view of a toothpaste dispenser on which the novel sanitary guard is about to be mounted.

Before describing the novel sanitary guard 10 a toothpaste dispenser 11 (FIGS. 3, 4, 6 and 7) with which guard 10 may function is first described. This is done first so that sanitary guard 10 will be better understood. In FIG. 3 is a side view of a toothpaste dispenser 11 on which a novel sanitary guard 10 may be mounted for use. Such fluid dispensers 11 are known in the art, particularly for dispensing soap. Accordingly, such prior art fluid dispensers are only described generally herein.

Toothpaste dispenser 11 comprises a base 11*a* in which are typically mounted a pump and batteries for powering the pump (not shown). There is also a top or head piece 11*b* in/on which are mounted an actuator button 11*e* that powers an air pump (not shown) to dispense toothpaste, and a cap 11*d* that may be easily opened to insert a viscous fluid toothpaste 12 into a clear plastic container 11*g* that is mounted in middle section 11*c*. The top surface of toothpaste 12 is shown rippled only to indicate it is a fluid. Positioned inside container 11*g* is a hollow tube 11*h* that is used to extract toothpaste 12 from container 11*g* and move it to head 11*b* where it is dispensed via the dispensing spout which comprises elements 11*f* and 11*i*. When actuator button 11*e* is depressed an air pump (not shown) mounted in base 11*a* pumps air into the top of container 11*g* as shown at arrow W3 in FIGS. 6 and 7. The air pressure causes toothpaste 12 to flow up tube 11*h* as indicated by arrow W4. The toothpaste 12 then exits toothpaste dispenser 11 via the dispensing spout 11*f*, and out spout 11*f*, 11*i* (FIG. 3) and through novel sanitary guard 10 onto bristles 26 of toothbrush 24 positioned under the dispensing spout and the sanitary guard 10 as shown in FIGS. 6-9.

Returning to the front view of novel sanitary guard 10 shown in FIG. 1, it comprises a circular top piece 17 having a hole 18 therefore that is used to mount guard 10 onto dispensing spout 11*f*, 11*i* as shown in FIGS. 4 and 6-9. The dispensing spout has a larger diameter portion 11*i* that fits with an interference fit into hole 18 of sanitary guard 10 as shown in FIGS. 4 and 6-9. Guard 10 has flared, open sides having four corner pieces 13, 14, 15 and 16 (16 not shown) that form a rectangle at the bottom of guard 10. The front view of guard 10 shown in FIG. 1 is the almost the same as the rear view (not shown). In the front view shown in FIG. 1 front legs 13 and 14 are shown and there are two legs 15, 16 on the rear side of guard 10 that are not seen in FIG. 1. There is a front to rear hole through sanitary guard 10 shown in FIG. 1 as element number 22. While the lower portion of guard 10 is shown in a rectangular form its shape can be square or oval. Similarly, the holes 22, 23 etc. through the sides of guard 10 may be oval or another shape.

The front side of sanitary guard 10 has a front bottom edge 20. Guard 10 also has a rear bottom edge that is not shown in any of the figures except as the line across the bottom of notch 19 in FIG. 1. Notch 19 in the front bottom edge 20 shows in the side view of FIG. 2 as a dotted line, and shows in FIGS. 8 and 9 with handle 25 of toothbrush 24 resting therein.

Figure 8:
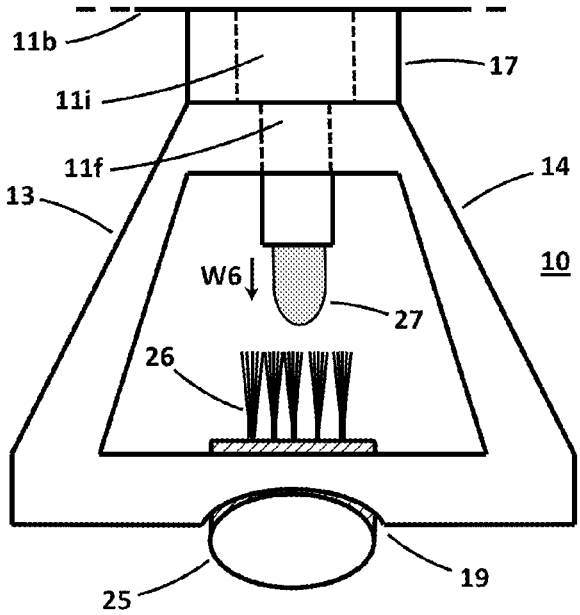
FIG. 8 is an enlarged front view of the novel sanitary guard mounted to the dispensing spout of a toothpaste dispenser with a toothbrush positioned thereunder and just about to received toothpaste onto the bristles of the toothbrush.
Figure 9:
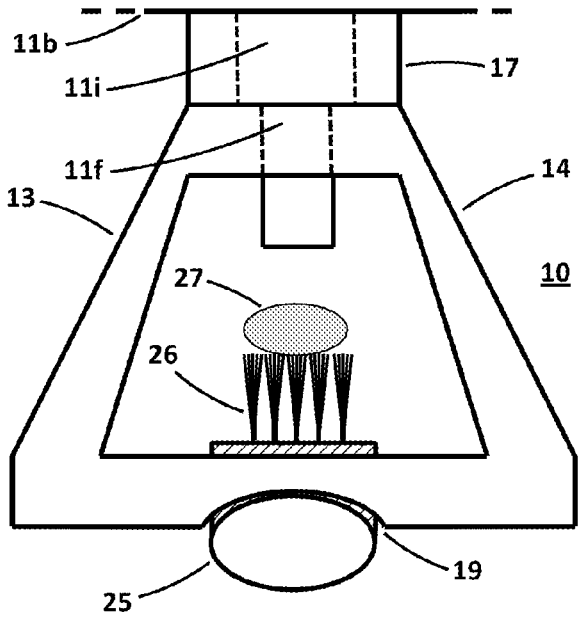
FIG. 9 is an enlarged front view of the novel sanitary guard mounted to the dispensing spout of a toothpaste dispenser with a toothbrush positioned thereunder and just after toothpaste has been dispensed onto the bristles of the toothbrush.

FIG. 2 shows a left side view of sanitary guard 10 and it is almost the same as the right side view of guard 10 (just reversed) which is not shown. The front side leg is designated 13 and the rear side leg is designated 15. Right side legs 14 and 16 are not seen in FIG. 2 but leg 14 is shown in FIGS. 8 and 9. The description of hole 18 is the same as it is for FIG. 1 which is given above. There is a left to right hole through the left and right sides of guard 10 shown in FIG. 2 as element number 23.

FIG. 3 shows the toothpaste dispenser 11, which has already been described, with sanitary guard 10 about to be installed to dispensing spout 11*i* and 11*f* by moving guard 10 in the direction of arrow W1 until guard 10 is in friction fit with spout 11*i*, 11*f* as previously described.

Figure 4:
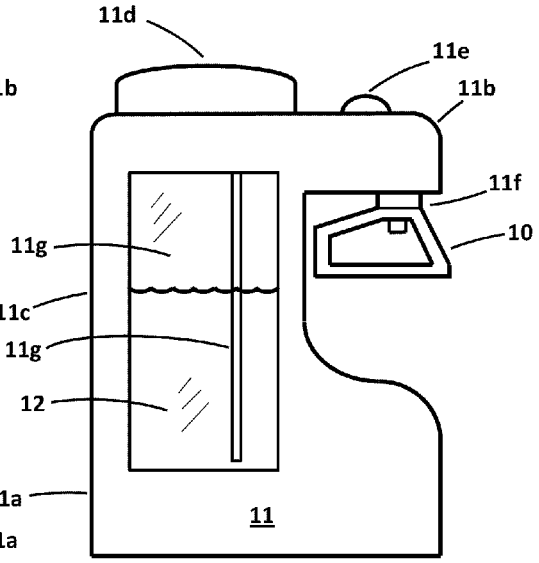
FIG. 4 is a side view of the toothpaste dispenser on which the novel sanitary guard is fully mounted for use.

FIG. 4 shows sanitary guard 10 fully mounted on dispensing spout 11*i* and 11*f* of toothpaste dispenser 11 and ready for use as described hereinafter.

Figure 5:
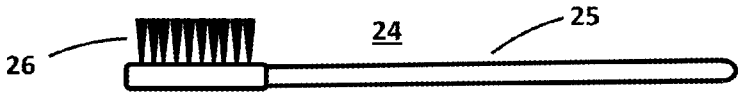
FIG. 5 is a side of a toothbrush.

FIG. 5 shows a toothbrush 24 having a handle 25 and a head with bristles 26 therein.

Figure 6:
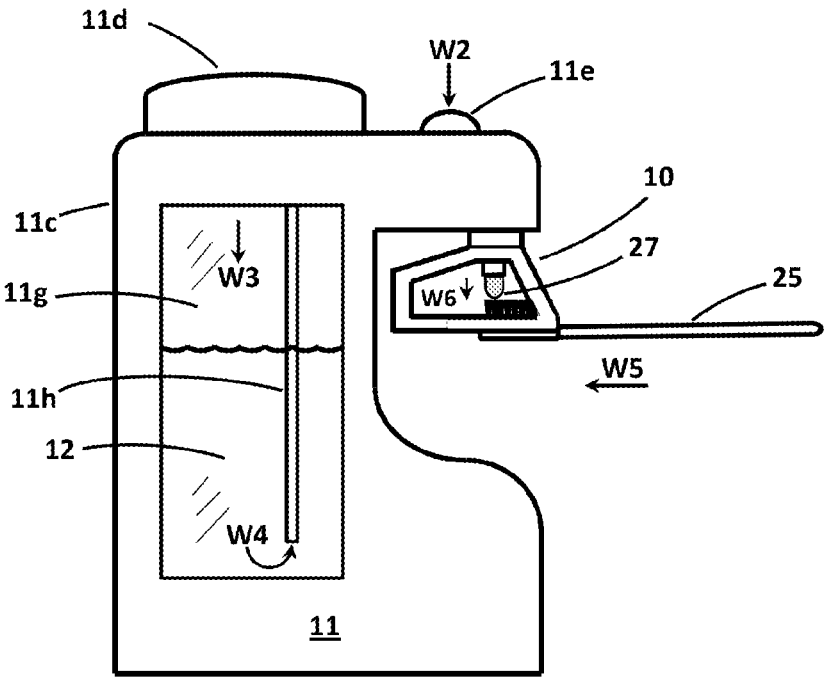
FIG. 6 is a side view of the toothpaste dispenser on which the novel sanitary guard is fully mounted for use, a toothbrush is positioned under the guard and the dispensing spout of the dispenser, and toothpaste is just commencing to be dispensed.
Figure 7:
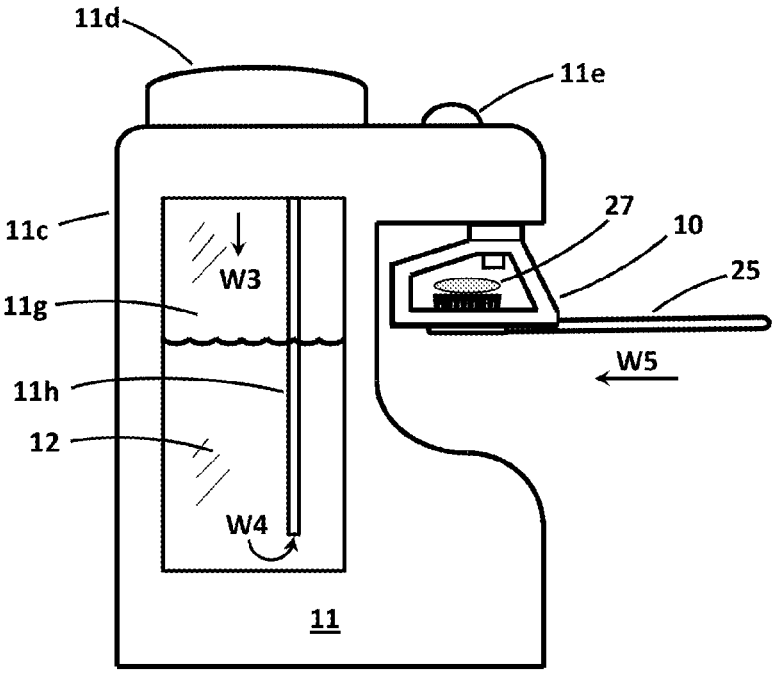
FIG. 7 is a side view of the toothpaste dispensing mechanism on which the novel sanitary guard is fully mounted for use, the toothbrush positioned under the guard has been moved along underneath the guard while toothpaste has been dispensed, and dispenser is turned off.

FIG. 6 shows a left view of sanitary guard 10 assembled to dispensing spout 11*i* and 11*f* of toothpaste dispenser 11 with toothbrush handle 25 positioned in the notch 19 (FIGS. 1 & 2) in the bottom front edge of guard 10 as better shown in and described hereinafter with reference to FIGS. 8 and 9. The bristles 26 are positioned under spout 11*f* as shown. Toothbrush 25 may start in the position shown in FIG. 6 and be pushed in the direction of arrow W5, or it may start in the position shown in FIG. 7 and be pulled from under the dispensing spout (arrow not shown). In FIG. 6 actuator button 11*e* is depressed by pressing it in the direction of arrow W2. This actuates an air pump (not shown) mounted in base 11*a* and air is pumped into the top of container 11*g* as shown as arrow W3 in FIG. 6 to dispense toothpaste 12. This has previously been described. In FIG. 6, toothpaste 27 is beginning to be dispensed but is not yet on bristles 26. As toothpaste 27 is being dispensed by just exiting spout 11*f* and the user slowly pushes the handle 25 of toothbrush 24 in the direction of arrow W5 until the proper amount of toothpaste 27 has been dispensed onto the toothbrush bristles as shown in FIG. 7. Actuator button 11*e* is then released. In an alternative embodiment of the invention, a timing mechanism may be embodied as known the prior art. When actuator button 11*e* is momentarily pressed it activates the air pump (not shown) for a pre-programmed amount of time to dispense toothpaste 27.

FIG. 7 shows toothpaste dispenser 11 with sanitary guard 10 mounted thereon after toothpaste 27 has been fully dispensed onto toothbrush bristles 26 and actuator button 11*e* has been released. Toothbrush 24 is then lowered to clear guard 10 and is removed to brush one's teeth. With this operation no part of toothbrush 24 touches dispensing spout 11*i* and 11*f* to contaminate it. Any microbes that may be transferred to sanitary guard 10 by toothbrush 24 touching it are killed by the nanosilver compounds in the antimicrobial plastic from which guard 10 is fabricated. This assures a sanitary operation where microbes and microorganisms such as bacteria, germs, viruses and mold are not passed from one person who utilizes toothpaste dispenser 11 to another person who utilizes the same dispenser.

FIG. 8 is an enlarged front view of the novel sanitary guard 10 mounted to the dispensing spout 11*f*, 11*i* of a toothpaste dispenser 11 with a toothbrush 24 positioned thereunder and just about to receive toothpaste 27 onto the bristles 26 of the toothbrush 24. The actuator button 11*e* has been depressed and toothpaste 27 is commencing to flow out of spout 11*f*,11*i* in the direction of arrow W6. Handle 25 of toothbrush 24 is in notch 19 on the underside of sanitary guard 10 and will be moved in or out of sanitary guard 10 to receive toothpaste 27 onto bristles 26 as shown in FIG. 7.

FIG. 9 is an enlarged front view of the novel sanitary guard 10 mounted to the dispensing spout 11*f*, 11*i* of a toothpaste dispenser 11 with a toothbrush 24 positioned thereunder after finishing receiving toothpaste 27 onto the bristles 26 of the toothbrush 24. The actuator button 11*e* has been released and no more toothpaste 27 is flowing out of spout 11*f*,11*i*. Handle 25 of toothbrush 24 is still in notch 19 on the underside of sanitary guard 10 and will be moved downward and then away from sanitary guard 10 in order to brush ones teeth.

As previously mentioned, the plastic from which sanitary guard 10 is made has nanosilver compounds therein giving it antimicrobial properties that kill microbes and microorganisms such as bacteria, germs, viruses and mold that attempt to grow on the surface of the sanitary guard. This helps prevent the spread of such harmful microbes and microorganisms between people using the same toothpaste dispenser equipped with sanitary guard 10. One company that sells such nanosilver plastic is BASF Corp., of Florham Park, N.J. Their plastic is an acrylonitrile-styrene-acrylate copolymer called Luran S BX 13042 that comes with a special additive containing silver manufactured by Agion Technologies. Antibacterial polymers have the advantage of not being much more expensive than ordinary plastic and the extra cost is around 10%.

One important feature is that microorganisms are unable to develop immunity to silver. The germicidal properties of silver were used 6,000 years ago by the Sumers who kept water in silver pots so that it could stay fresh for longer, and dropped silver coins into pots with milk to prevent it from going bad. During great epidemics, people who used silverware were more likely to survive. Small children were fed with silver spoons in order to boost their immunity. Wounds were treated with silver compounds that accelerated healing.

In an alternative embodiment of the invention the toothpaste dispenser 11 will not have a dispensing spout 11*f*, 11*i* to which sanitary guard 10 will attach with an interference fit. To overcome this shortcoming an adapter is provided. The adapter has an adhesive strip attached thereto that is used to attach the adapter to the underside of top 11*b* of dispenser 11 in registration with the opening from which toothpaste 12 is dispensed. The adapter has a dispensing spout 11*f*, 11*i* to which sanitary guard 10 will properly attach with an interference fit. Alternatively, a dispensing spout 10 may be made an integral part of dispenser 11 and need not be fitted to dispenser 11.

While what has been described herein above is the preferred embodiment of the invention, numerous changes may be made without departing from the spirit and scope of the invention.

The invention claimed is:

1. A sanitary guard for an automatic toothpaste dispenser that has a dispensing spout to which the sanitary guard attaches, the sanitary guard helping to prevent a toothbrush having a handle, head and bristles on the head from coming into contact with the dispensing spout, the sanitary guard comprising;

attachment means for detachably attaching the sanitary guard to the dispensing spout of the automatic toothpaste dispenser; and a shroud extending downward and away from the attachment means, the shroud having a first end non-movably attached to the attachment means and having a second end remote from the attachment means, the shroud having openings therein through which a user of the toothpaste dispenser with sanitary guard looks to assist in positioning the toothbrush under the dispensing spout to have toothpaste dispensed onto the bristles of the toothbrush;

wherein when toothpaste is to be dispensed onto a toothbrush the handle of the toothbrush is brought into contact with the remote second end of the shroud so that the head and bristles of the toothbrush are directly below but physically spaced from the dispensing spout, and toothpaste is dispensed onto the toothbrush bristles without the bristles ever physically touching the sanitary guard or the toothpaste dispenser, and this physical spacing prevents the transfer of microbes between the toothbrush head and bristles and the dispensing spout, and wherein the sanitary guard is a single piece where the attachment means and shroud do not move with respect to each other.

2. The sanitary guard for an automatic toothpaste dispenser of claim 1 wherein there is a notch in the remote second end of the shroud in which the handle of the toothbrush is placed to assist in positioning the toothbrush head and bristles thereon below the dispensing spout to help assure that toothpaste is dispensed only onto the bristles in the head of the toothbrush.

3. The sanitary guard for an automatic toothpaste dispenser of claim 2 wherein the sanitary guard is made from a material having germicidal properties to kill any microbes that may be transferred to the sanitary guard.

4. The sanitary guard for an automatic toothpaste dispenser of claim 1 wherein the sanitary guard is made from a material having nanosilver therein to kill any microbes that may be transferred to the sanitary guard.

5. The sanitary guard for an automatic toothpaste dispenser of claim 1 wherein the sanitary guard is made from a material having germicidal properties to kill any microbes that may be transferred to the sanitary guard.

6. The sanitary guard for an automatic toothpaste dispenser of claim 5 wherein the material having germicidal properties has nanosilver therein.

7. The sanitary guard for an automatic toothpaste dispenser of claim 3 wherein the material having germicidal properties from which the sanitary guard is made has nanosilver compounds therein to kill any microbes that may be transferred to the sanitary guard.

8. The sanitary guard for an automatic toothpaste dispenser of claim 1 wherein the attachment means is a friction fit of the sanitary guard to the dispensing spout.

* * * * *